US005608498A

United States Patent [19]

Nagase et al.

[11] Patent Number: 5,608,498

[45] Date of Patent: Mar. 4, 1997

[54] IMAGE FORMING APPARATUS IN WHICH AT LEAST AN IMAGE CARRYING MEMBER AND PLURAL EXPOSURE MEANS ARE CONSTRUCTED IN A SINGLE BODY

[75] Inventors: Hisayoshi Nagase; Shuta Hamada; Satoshi Haneda, all of Hachioji, Japan

[73] Assignee: Konica Corporation, Tokyo, Japan

[21] Appl. No.: 592,564

[22] Filed: Jan. 26, 1996

[30] Foreign Application Priority Data

Feb. 3, 1995 [JP] Japan ..... 7-016921
Feb. 17, 1995 [JP] Japan ..... 7-029473

[51] Int. Cl.[6] ..... G03G 15/00

[52] U.S. Cl. ..... 399/130; 347/138; 347/152; 399/167; 399/226

[58] Field of Search ..... 355/200, 210, 355/211, 326 R, 327; 347/138, 152

[56] References Cited

U.S. PATENT DOCUMENTS 4,961,094 10/1990 Yamaoki et al. ..... 355/326 R
5,444,515 8/1995 Haneda et al. ..... 355/200
5,541,722 7/1996 Ikeda et al. ..... 355/326 R

FOREIGN PATENT DOCUMENTS 4-70867 3/1992 Japan ..... 355/210
5-307307 11/1993 Japan .

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

In a color image forming apparatus in which each of charging devices, image exposure devices and developing devices is provided in plural sets corresponding in number to plural different color components and placed in such an arrangement that the plural different color component toner images are superimposed on the image carrying member during a single rotation of the image carrying member, all of the plural image exposure means, and the image carrying member are constructed in a single body and is shiftable together in a direction perpendicular to the rotation axis of the image carrying member from or to the working position of the image carrying member.

21 Claims, 11 Drawing Sheets

IMAGE FORMING APPARATUS IN WHICH AT LEAST AN IMAGE CARRYING MEMBER AND PLURAL EXPOSURE MEANS ARE CONSTRUCTED IN A SINGLE BODY

BACKGROUND OF THE INVENTION

The present invention relates to an electrophotographic color image forming apparatus in which a plurality of charging means, image exposure means and developing means are arranged around the circumferential surface of an image forming member, and toner images are formed and superimposed while the image-forming member is rotated by a single rotation.

As an apparatus for forming a full color image, the following type of a color image forming apparatus is well known: each of a charging device, an image exposure device and a developing device is provided in the same number of sets as different component colors necessary to form a full color image around the circumferential surface of the image forming member, the steps of charging, imagewise exposing and developing are sequentially conducted for each component color so as to form and superimpose different color toner images during a single rotation of the image forming member, and the thus formed color toner image is transferred to a transfer material at one time.

The above apparatus has features that a color image formation speed is very fast and that it is possible to form a color image longer than the length of the circumferential surface of the image forming member, because the toner image formation for each color is successively started at a slight time delay after the start of the previous image formation.

However, in the above color image forming apparatus, since each of the charging devices, the image exposure device and the developing device is provided in plural sets around the circumferential surface of the image forming member, if the apparatus is to be constructed compactly, each device is inevitably positioned very close to others and the construction becomes complicated. As a result, there may be problems that maintenance works such as paper jam clearing, cleaning, part replacement require much time and labor.

SUMMARY OF THE INVENTION

The present invention was conceived to overcome the above problems. The objective of the present invention is to provide a color image forming apparatus in which each device is structured in a single unit with the image forming member so that the paper jam clearing and maintenance work of the machinery components are conducted easily.

First Embodiment

In the first embodiment, in a color image forming apparatus in which each of a charging means, an image exposing means and a developing means are provided in plural sets around the circumferential surface of the image forming member, the charging, the imagewise exposing and the developing are repeated during each rotation of the image forming member so as to superimpose toner images, and thereafter the toner images are transferred one at a time to a transfer material, the plural image exposing means are integrally mounted on a common supporting member and can be attached to or detached from the apparatus body together with the image forming member in a direction perpendicular to the axis of rotation of the image forming member.

Further, the first embodiment is structured as follows:

(a) Driving Means

In a color image forming apparatus in which each of a charging means, an image exposing means and a developing means are provided in plural sets around the circumferential surface of the image forming member, the charging, the imagewise exposing and the developing are repeated during a single rotation of the image forming member so as to superimpose toner images, and thereafter the toner images are transferred at a time to a transfer material, the plural developing means are arranged symmetrically on right and left of the horizontal plane on the axis of the image forming member and on the upper or lower parallel plane to the horizontal plane and can be moved upward together with the image forming member so that a driven gear of each developing means can be simultaneously engaged with or disengaged from a corresponding driving gear provided on the apparatus body.

(b) Image Forming Member

In a color image forming apparatus in which each of a charging means, an image exposing means and a developing means are provided in plural sets around the circumferential surface of the image forming member, the charging, the imagewise exposing and the developing are repeated during a single rotation of the image forming member so as to superimpose toner images, and thereafter the toner images are transferred at a time to a transfer material, the plural image exposing means are integrally mounted on a common supporting member and can be shifted together with the image forming member in a direction perpendicular to the axis of rotation of the image forming member and at the shifted position the image forming member is attached to or detached from the common supporting member on which the plural image exposing members are integrally mounted.

(c) Maintenance

In a color image forming apparatus in which each of a charging means, an image exposing means and a developing means are provided by plural sets along the circumferential surface of the image forming member, the charging, the imagewise exposing and the developing are repeated for a single rotation of the image forming member so as to superimpose toner images, and thereafter the toner images are transferred at a time to a transfer material, the plural image exposing means are integrally mounted on a common supporting member and can be shifted together with the image forming member in a direction perpendicular to the axis of rotation of the image forming member and the cleaning or the replacing of the charging means, the image exposure means, the developing means or the cleaning means can be conducted easily at the shifted position.

Second Embodiment

In the second embodiment, in a color image forming apparatus in which each of a charging means, an image exposing means and a developing means are provided by plural sets along the circumferential surface of the image forming member, the charging, the imagewise exposing and the developing are repeated for a single rotation of the image forming member so as to superimpose toner images, and thereafter the toner images are transferred at a time to a transfer material, the image forming member, the plural charging means, the plural image exposing means, and the plural developing means are integrally constructed in a process cartridge and are drawn in a horizontal direction from an image forming position to a predetermined position after a side cover member of the apparatus body is opened.

DETAILED DESCRIPTION OF THE PREFERRED EMBODIMENT

Figure 1:
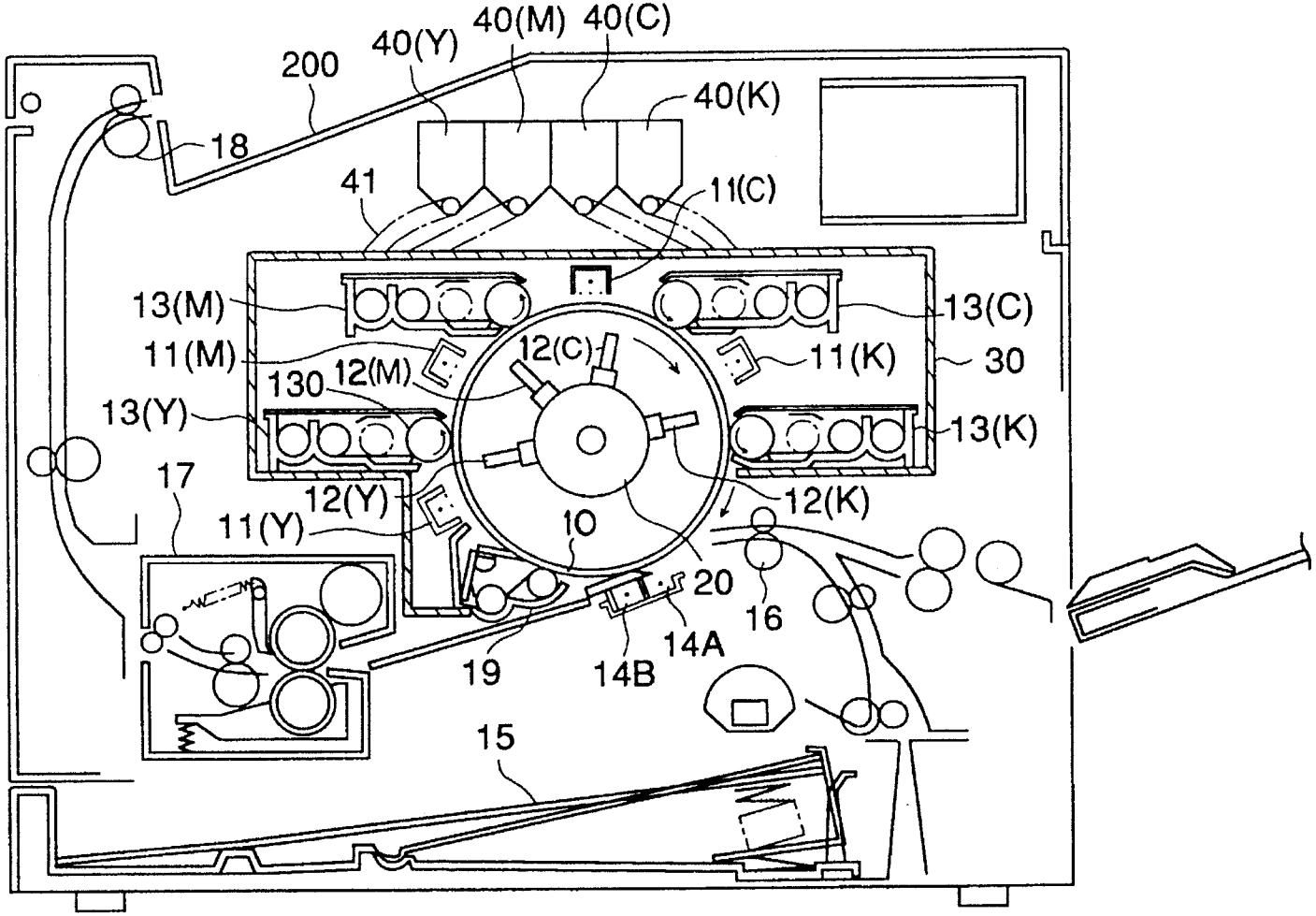
FIG. 1 is a sectional view showing construction of a color image forming apparatus of the first embodiment of the present invention.

Before the explanation of each embodiment of the present invention, the structure and function of a color image forming apparatus of the present invention will be explained as follows, referring to FIGS. 1 through 5. FIG. 1 is a view showing an example of a color image forming apparatus of the present invention. In FIG. 1, numeral 10 is a photoreceptor drum used as a drum-shaped image-forming member on which an electrically conductive transparent layer and a photosensitive layer made of an organic photoconductor (OPC) or α-Si are provided on the outer periphery of a cylindrical base drum made of a transparent material such as an optical glass and a transparent acryl resin. A flange on one end of the photoreceptor drum 10 is supported with a bearing in the guide plate, and another flange on the other end is circumscribed with each of plural guide rollers. A wheel gear provided on the outer periphery of the photoreceptor drum is engaged with a driving gear, by the driving force through which the photoreceptor drum is rotated clockwise on the condition that the electrically conductive transparent layer is grounded.

In the present invention, for the light decay characteristic of the photoconductive layer where there is an image forming point of an exposure beam for exposing an image, it may be permissible for the exposure beam to have a wavelength and an exposure amount sufficient to provide a proper contrast. Accordingly, a 100% light transmission rate of the transparent base drum of the photoreceptor drum 10 of the present invention may not be necessary, the transparent base drum may absorb a certain amount of light in the time that the exposure beam passes through it. As a material of a light transmittable base drum, soda glass, pyrex glass and borosilicate glass may be used. Also, various light transmittable resins used as a general optical member such as fluororesin, polyester, polycarbonate, and polyethylene terephthalate may used as the material of the light transmittable base drum. As a light transmittable conductive layer, a light transmittable metal layer made of indium, tin oxide (ITO), stannic oxide, lead oxide, indium oxide, copper iodide, Au, Ag, Ni, Al may be used. As a layer forming method, vacuum deposition, activated reaction deposition, various spattering methods, various CVD methods, dipping coating, spray coating may be adopted. As a photoconductive layer, amorphous silicone (a-Si) alloy photosensitive layer, amorphous selene alloy photosensitive layer, and various organic photoconductive layers (OPC) may be used.

The notations 11(Y), 11(M), 11(C) and 11(K) represent respectively a charging device as a charging means used in the corresponding color image forming process for yellow (Y), magenta (M), cyan (C) and black (K). Each charging device conducts an electrical charging action for the organic photoconductor layer of the photoreceptor drum 10 by corona discharge with the use of a grid retained at a predetermined potential level and a corona wire, thus the photoreceptor drum 10 is given uniform potential voltage.

Notations 12(Y), 12(M), 12(C) and 12(K) represent respectively an optical exposure system used as image exposure means composed of light emitting elements such as LED, FL, EL, and PL arranged in the axial direction of the photoreceptor drum 10 and image forming elements such as a Selfoc lens. Image signals for each color read by a separate image reading device are taken out successively from a memory and are inputted as electric signals into each of the optical exposure systems 12(Y), 12(M), 12(C) and 12(K).

Each of the optical exposure systems 12(Y), 12(M), 12(C) and 12(K) is mounted on a column-shaped supporting member 20 as a common supporting body which is fixed inside a cartridge mentioned later and is accommodated inside the photoreceptor drum 10. Instead of the above construction, the optical exposure system 12 may be composed of light emitting elements combined with optical shutter members such as LCD, LISA, PLZT and image forming elements such as a Selfoc lens.

The notations 13(Y), 13(M), 13(C), and 13(K) are developing devices used as developing means containing a corresponding color developing agent of yellow (Y), magenta (M), cyan (C) and K (black). Each developing device 13 is equipped with a developing sleeve 130 which locates to keep a predetermined gap distance to a circumferential surface of the photoreceptor drum 10 and rotates in the same direction as that of the photoreceptor drum 10. Each developing device 13 is further equipped with a pressing device by which contacting members provided on both shaft ends of the developing sleeve 130 are brought in pressure contact with portions out of an image forming region on the circumferential surface of the photoreceptor drum 10 so that a predetermined gap distance of 0.2 mm to 1.0 mm is set between the developing sleeve 130 and the drum surface.

Each of the developing devices 13(Y), 13(M), 13(C) and 13(K) conducts a reversal development with a non-contact developing technique under the application of a developing bias voltage for an electrostatic latent image which has been formed for each color on the photoreceptor drum 10 through a charging process by the corresponding one of the charging devices 11(Y), 11(M), 11(C) and 11(K) and an image exposure process by the corresponding one of the optical exposure systems 12(Y), 12(M), 12(C) and 12(K).

Image data obtained by reading an image on a document with the use of an image sensor in an image reading device which is separate from the present apparatus, or image data compiled by a computer are processed and stored in a memory temporarily as image signals of each of colors Y, M, C and K.

At the start of an image recording, a photoreceptor driving motor starts driving so as to rotate the photoreceptor drum 10 clockwise and, simultaneously, the charging device 11(Y) starts providing an electric potential to the photoreceptor drum 10 through its charging action.

After the photosensitive layer of the photoreceptor drum 10 has been provided with the electric potential, an image exposure is started by electric signals corresponding to the first color signals, that is, yellow (Y) image signals in the optical exposure system 12(Y), and an electrostatic latent image corresponding to a yellow (Y) component image of the document image is formed on the photosensitive layer on the drum surface with the subscanning by the rotation of the photoreceptor drum 10.

The latent image is subjected to the reversal development conducted by a developing unit 13(Y) under the non-contact condition of developing agent on a developing sleeve, and a yellow (Y) toner image is formed on the photoreceptor drum 10 as the photoreceptor drum 10 rotates.

Then, photoreceptor drum 10 is further provided with an electric potential on the yellow (Y) toner image previously formed thereon through a charging operation of the charging unit 11(M), then an image exposure is conducted by electric signals corresponding to the second color signals, that is, magenta (M) image signals, in the optical exposure system 12(M), and a magenta (M) toner image is superimposed on the yellow (Y) toner image with the non-contact type reversal development technique by the developing unit 13(M).

With the same process as in the foregoing, a cyan (C) toner image corresponding to the third color signals is formed and superimposed by the charging unit 11(C), the optical exposure system 12(C) and the developing unit 13(C), and, lastly, a black (K) toner image corresponding to the fourth color signal is formed and superimposed in succession by the charging unit 11(K), the optical exposure system 12(K) and the developing unit 13(K), whereby a color toner image is formed on the circumferential surface of the photoreceptor drum 10 during its single rotation.

An image exposure by the optical exposure systems 12 onto the photosensitive layer on the photoreceptor drum 10 is conducted through the transparent base drum from the inside of the photoreceptor drum 10. Accordingly, each image exposure for the second, third and fourth color signals is conducted without passing through the previously formed toner image so that a latent image of each of the second, third and fourth color signals can be formed at the same quality as the first image signal. Incidentally, temperature stabilization and temperature-rise prevention in the photoreceptor drum 10 can be conducted in the following ways to counter heat generated by the optical exposure systems 12(Y) through 12(K): A material possessing good heat conductivity is used for the supporting member 20. To counter low temperature in the photoreceptor drum 10, a heater may be used. In contrast, when the temperature is too high, the heat is radiated away through a heat pipe to the outside, whereby the temperature can be regulated to such an extent that no trouble occurs. During the developing process by each of the developing devices 13, each of the developing sleeves 130 is applied with a developing bias voltage of DC or a superimposition of DC and AC, whereby the jumping development is conducted by single component developer or two component developer stored in the developing devices 13, and the photoreceptor drum 10 in which the electrically conductive transparent layer is grounded is subjected to the reversal development under the non-contact condition of the developer.

A color toner image thus formed on the peripheral surface of the photoreceptor drum 10 is transferred in a transfer device 14A onto a transfer sheet used as a transfer material which is delivered from a sheet feed cassette 15 and is fed synchronously with the toner image on the photoreceptor drum 10 by the drive of the timing roller 16.

The transfer sheet onto which the toner image has been transferred is electrically discharged by a discharger 14B, so that the transfer sheet is separated from the peripheral surface of the drum. In a fixing unit 17, the toner image is fused and fixed onto the transfer sheet. After that, the transfer sheet is discharged into a paper discharge tray 200 on a upper portion of the apparatus through a paper discharge roller 18.

On the other hand, after the transfer sheet has been separated from the photoreceptor drum 10, the residual toner on the surface of the photoreceptor drum 10 is removed and the surface of the photoreceptor drum 10 is cleaned with a cleaning device 19. In this way, the toner image formation is continued for a document image, or alternatively the toner image formation is temporarily stopped and the apparatus waits for the next toner image formation for a new document image.

In addition to the photoreceptor drum 10, the charging devices 11, the developing devices 13 and the cleaning device 19 are mounted integrally in a cartridge 30 and are mounted as a single unit in the apparatus body.

On the other hand, the optical exposure systems 12 are also integrated on the supporting member 20 used as a common supporting body, and are incorporated in the cartridge 30 so that the optical exposure systems 12 can be mounted in or dismounted from the apparatus body together with the photoreceptor drum 10.

Further, toner storing containers 40(Y), 40(M), 40(C) and 40(K) are mounted on a upper portion of the cartridge 30, and are connected respectively with the corresponding developing devices 13 through a toner feeding pipe 41.

Figure 2:
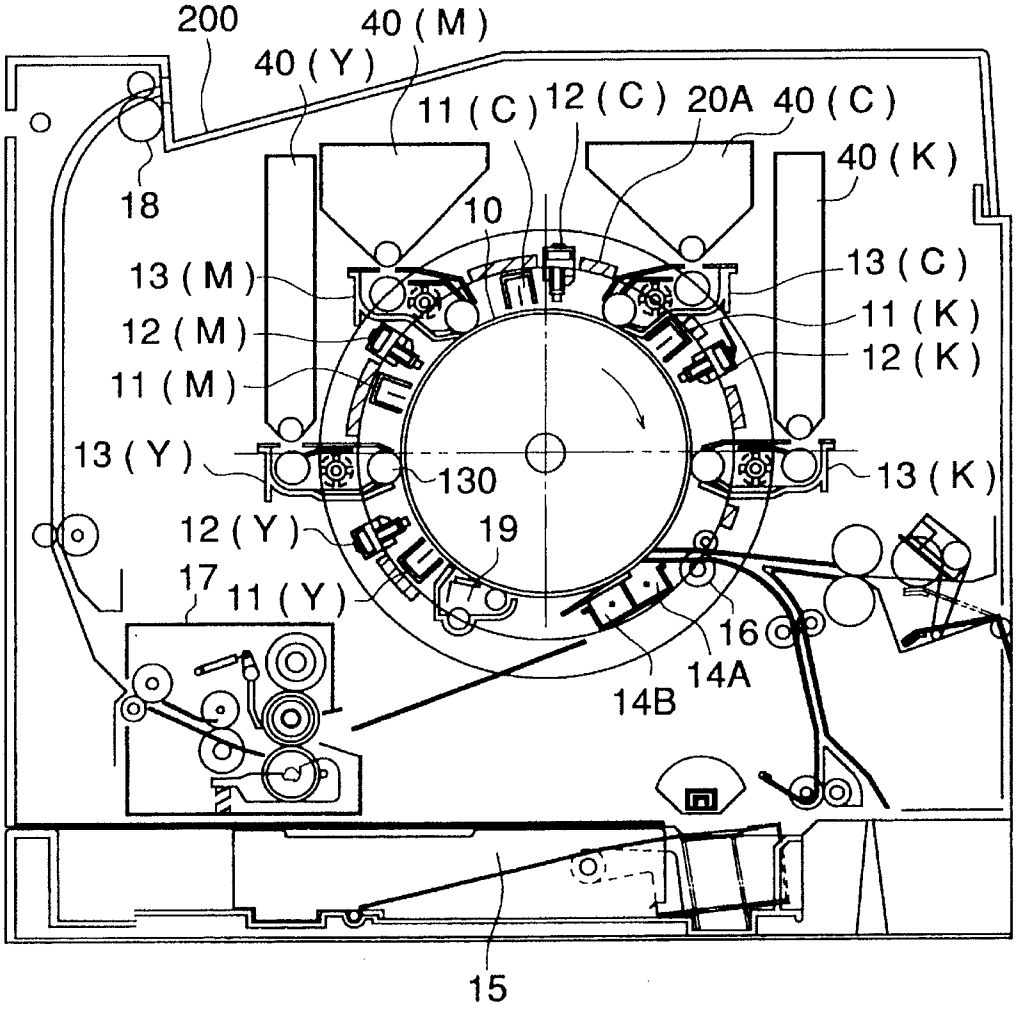
FIG. 2 is a sectional view showing another construction of a color image forming apparatus of the first embodiment of the present invention.

Incidentally, in addition to the color image forming apparatus shown in FIG. 1 in which the optical exposure systems 12 are incorporated inside the photoreceptor drum 10, the present invention can be also applied to the other type of color image forming apparatus shown in FIG. 2 in which the optical exposure systems 12 are mounted on a ring-shaped supporting member used as a common supporting body which is provided around the outer periphery of the photoreceptor drum 10 and an image exposure is conducted onto the photoreceptor drum 10 which is composed of a non-transparent body from the outside of the photoreceptor drum 10.

First Embodiment

The first embodiment will be explained with reference to FIGS. 3 through 5.

Figure 3:
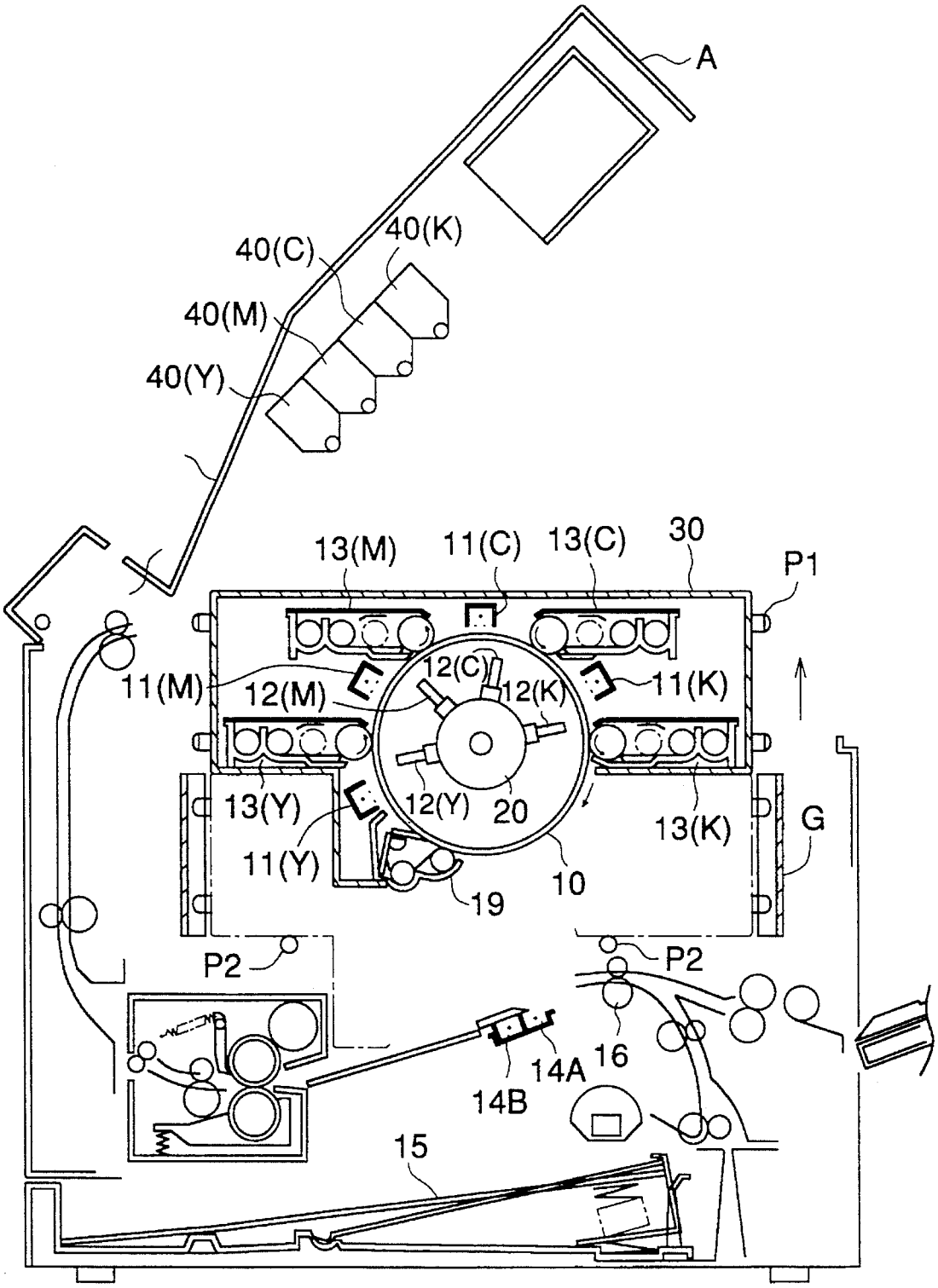
FIG. 3 is a sectional view showing the construction of a shifting means for a cartridge (first type).

As shown with a one-dot chain line in FIG. 3, on the condition that guide pins P1 provided on both sides of the cartridge 30 are engaged with guide rails G provided on the apparatus body so that the right and left positions of the cartridge 30 are regulated, the cartridge 30 is set at the predetermined image forming position when its bottom surface comes into contact with a stop pin P2.

The apparatus body is structured in such a manner that its upper cover A can be opened and closed, whereby the cartridge 30 can be shifted in a direction perpendicular to the center axis of the rotation of the photoreceptor drum 10 or in the arrowed direction in FIG. 3 and the guide pins P1 can be released from the engagement with the guide rails G.

Thereafter, the cartridge 30 can be dismounted from the apparatus body in the shifted position indicated with a solid line. Further, in the shifted position, the cartridge 30 can be mounted again on the apparatus body.

When the cartridge 30 is dismounted from the apparatus body, in order to disconnect the toner storage containers 40 from the developing devices 13, the toner feeding pipes are removed. By the dismounting of the cartridge 30 from the apparatus body, the conveying section of the transfer sheet including the transfer section of the toner image is opened so wide that maintenance such as paper jam clearing can be conducted. Further, by the separation of the photoreceptor drum 10 from the optical exposure systems 12, the cleaning or replacing of the optical system can be easily conducted.

Figure 4:
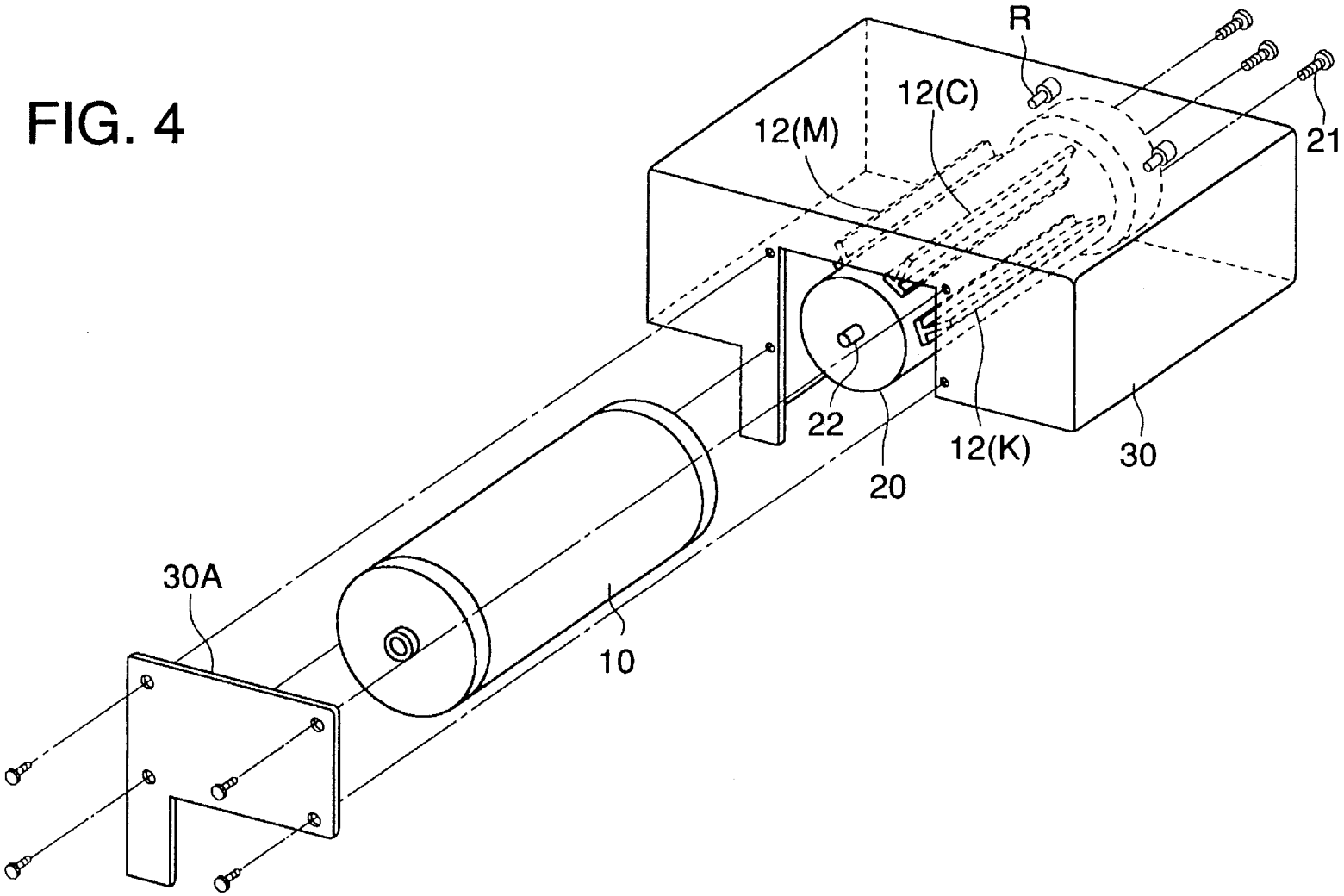
FIG. 4 is a perspective view of the cartridge (first type).

FIG. 4 is a developed view of the cartridge 30. The supporting member 20 on which all of the optical exposure systems 12 are supported is fastened from the back of the cartridge 30 with screw members 21 and is fixed in the cartridge 30. The hollow portion provided on the front end plate of the photoreceptor drum 10 is fit with the shaft 22 on the front end plate of the supporting mender 20, on the other hand, the cylinder portion at the rear end of the photoreceptor drum 10 is fitted onto the outer periphery of plural guide rollers R provided on the inside of the cartridge 30, whereby the photoreceptor drum 10 is rotatably supported.

In the above construction, by the removal of the front cover 30A from the cartridge 30, the photoreceptor drum 10 can be detached from the inside of the cartridge 30 so that the photoreceptor drum 10 can be separated from the optical exposure system 12. When the photoreceptor drum 10 is detached, the contacting member of each developing device 13 is released from pressure contact with the periphery surface of the photoreceptor drum 10 with the aid of the pressing device and is spaced from the periphery surface of the photoreceptor drum 10, whereby the photoreceptor drum 10 can be safely attached to or detached from the cartridge 30 without being damaged.

Further, if a stopping member to stop the cartridge 30 temporarily at a shifted position in the apparatus body is provided, the apparatus may be so structured that the cartridge 30 is stopped temporarily by the stop member when the cartridge 30 is pulled upward, and thereafter, the cartridge 30 may be dismounted from the stopped position to the outside of the apparatus body, or the photoreceptor drum 10 is dismounted from the cartridge 30 on the stopped position.

Figure 5:
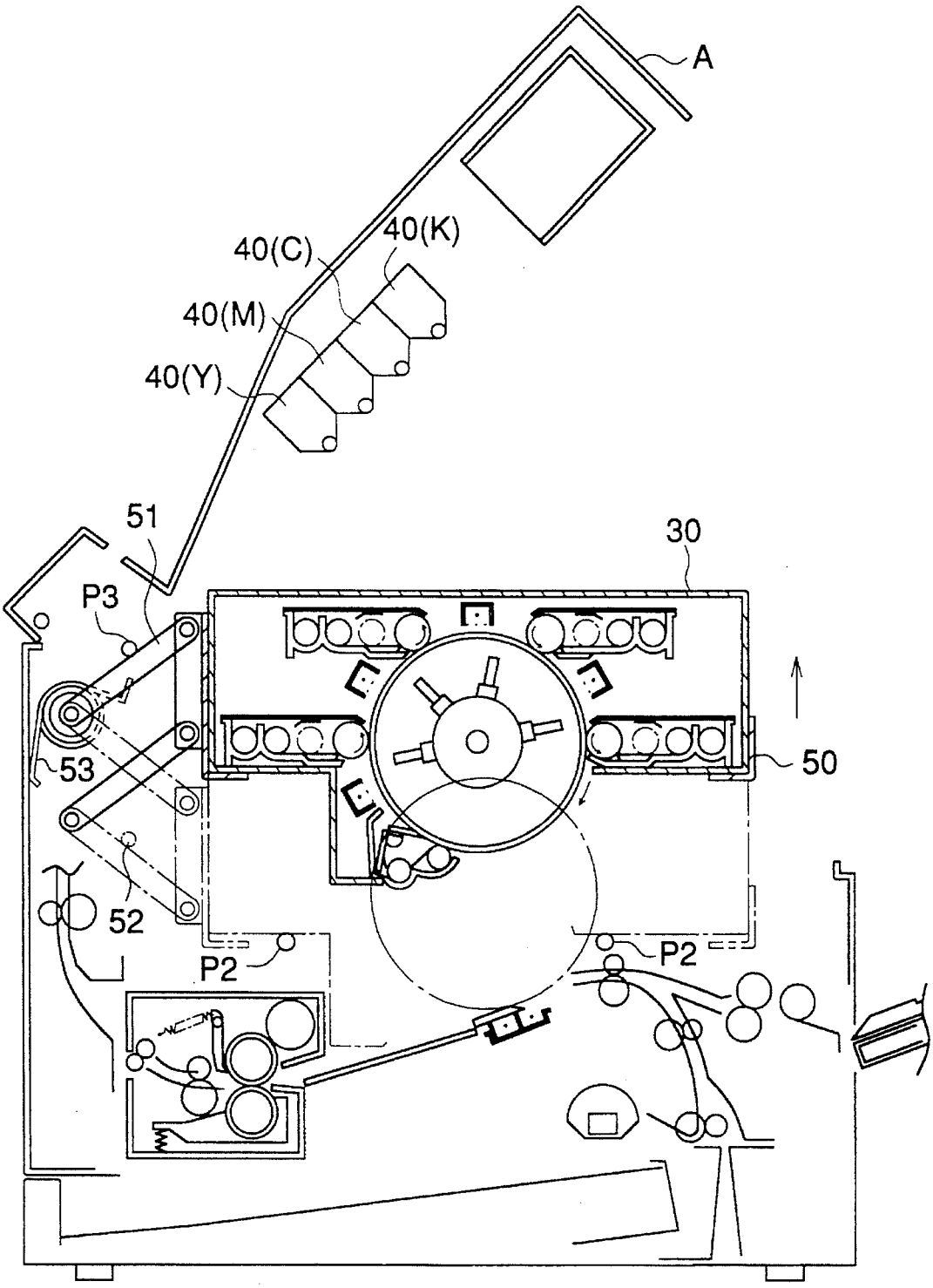
FIG. 5 is a sectional view showing the construction of a shifting means for a cartridge (second type).

A base plate 50 which is moved in parallel upward or downward by the support of a pair of arms 51 provided as shown in FIG. 5 is provided in the apparatus body, and the cartridge 30 is placed on the base plate 50 so that its position is secured.

Namely, as shown with a one point dotted line, on the condition that the base plate 50 is placed at its lower position and the arms 51 are engaged with a lock member 52, the cartridge 30 is brought in contact with the stop pin P2 and is set at the predetermined image forming position. When the lock member 52 is operated so as to retract in the direction perpendicular to the sheet surface of FIG. 5, the arms 51 are released from the engagement with the lock member 52, the base plate 50 is moved upward together with the cartridge 30 by the biasing force of coil spring 53 and the base plate is stopped at the shifted position on which the arms 51 come in contact with stop pin P3.

The cartridge 30 can be detached from the base plate 50 on the shifted position, whereby the cartridge 30 is dismounted from the apparatus body. After the dismounting of the cartridge 30, as explained previously with reference to FIG. 4, the photoreceptor drum 10 is separated from all the optical exposure systems 12 and is dismounted from the cartridge 30.

In the same way as explained previously with regard to the apparatus body with reference to FIG. 3, maintenance such as paper jam clearing, and the cleaning or the replacing for the optical exposure systems can be conducted easily.

An embodiment regarding "(a) Driving Means" will be explained with reference to FIGS. 3, 6 and 7. As shown with a one-dot chain line in FIG. 3, on the condition that guide pins P1 provided on both sides of the cartridge 30 are engaged with guide rails G provided on the apparatus body so that the right and left positions of the cartridge 30 are regulated, the cartridge 30 is set at the predetermined image forming position when its bottom surface comes in contact with the stop pin P2.

The apparatus body is structured in such a manner that its upper cover A can be opened or closed, whereby the cartridge 30 can be shifted perpendicularly to the axial center of the rotation of the photoreceptor drum 10 or in the arrowed direction in FIG. 3 and the guide pins P1 can be released from engagement with the guide rails G. Thereafter, the cartridge 30 can be dismounted from the apparatus body in the shifted position indicated with a solid line. Further, in the shifted position, the cartridge 30 can be mounted again on the apparatus body.

When the cartridge 30 is dismounted from the apparatus body, in order to disconnect the toner storage containers 40 from the developing devices 13, the toner feeding pipes are removed.

By dismounting the cartridge 30 from the apparatus body, the conveying section of the transfer sheet including the transfer section of the toner image is opened so wide that maintenance such as paper jam clearing can be conducted. Further, by separation of the photoreceptor drum 10 from the optical exposure systems 12, cleaning or replacing of the optical system can be conducted.

Figure 6:
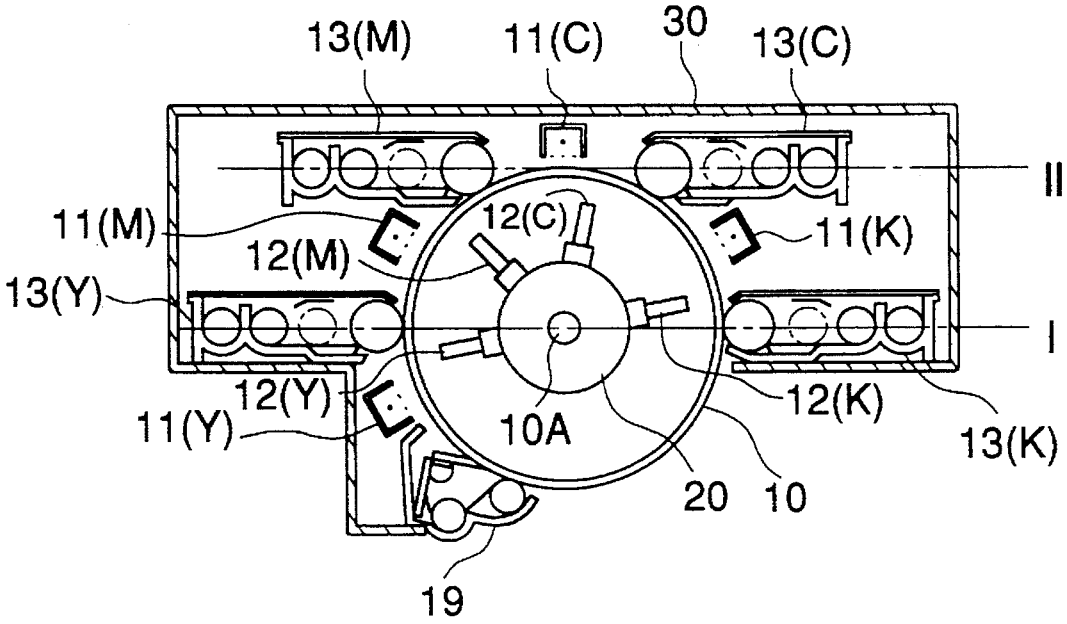
FIG. 6 is an explanatory view showing a lay-out of a developing device.
Figure 7:
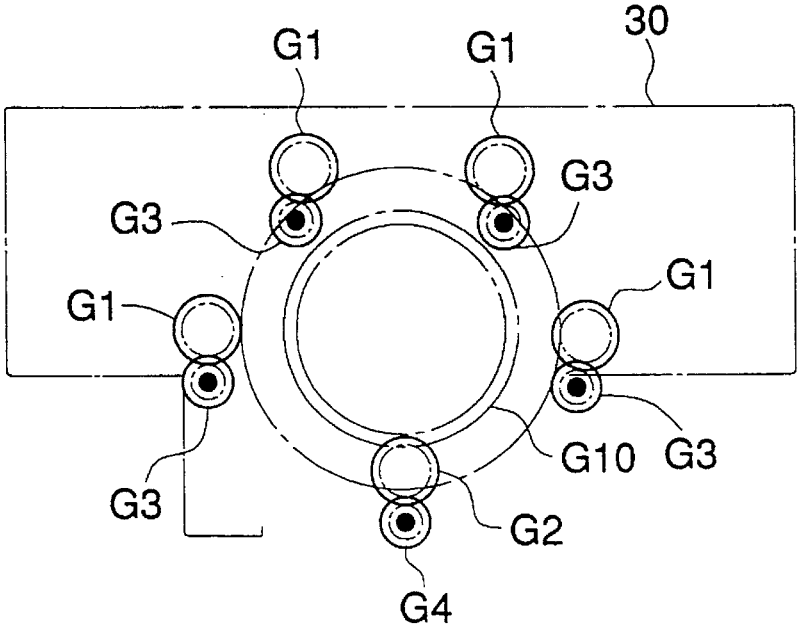
FIG. 7 is an explanatory view showing a lay-out of gears.

As shown in FIG. 6, the developing devices 13(Y) and 13(K) are arranged symmetrically on the right and left sides of the photoreceptor drum 10 on horizontal plane I on which the rotation center 10A of the photoreceptor drum 10 locates, and the developing devices 13(M) and 13(C) are also arranged symmetrically on the right and left sides of the photoreceptor drum 10 on plane II positioned slightly above and parallel to the horizontal plane I. Accordingly, the developing devices 13(Y), 13(K), 13(M) and 13(C) are arranged at different positions in the horizontal direction when viewed from the top of cartridge 30.

Each developing device 13 is provided with a driven gear G1 to transmit rotation to a developing sleeve 130 and each driven gear G1 protrudes from the rear of the cartridge 30. On the other hand, the photoreceptor drum 10 is provided with a driven gear G2 which engages with a wheel gear mounted on the rear end of the photoreceptor drum 10 and the driven gear G2 also protrudes from the rear of the cartridge 30.

If the driven gear G2 is arranged near or at the lowest position in the abovementioned arrangement of the developing devices 13, each of driven gears G1 and G2 is arranged at different positions on the same horizontal plane. Accordingly, if the driven gears G1 and G2 are engaged from the top with driving gears G3 and G4 provided on the apparatus body when the cartridge 30 is attached, all the driven gears G1 and G2 can be engaged with or disengaged from driving gears G3 and G4 without interfering with each other when the cartridge is attached to or detached from the apparatus body.

Consequently, with the attaching or detaching operation for the cartridge 30, the driving systems of all of the developing devices 13 and the photoreceptor drum 10 are automatically connected or disconnected. Further, receptacles are provided between the cartridge 30 and the apparatus body, whereby the electric system connection or disconnection can be conducted. As a result, maintenance is reduced and simplified.

An embodiment labeled "(b) Image Forming Member" will be explained with reference to FIGS. 4 and 5.

When the upper cover A is opened, the apparatus body allows the cartridge 30 to shift upward, and the toner storage containers 40 are shifted upward together when the upper cover A is opened.

A base plate 50 which is moved in parallel upward or downward by the support of a pair of arms 51 provided as shown in FIG. 5 is provided in the apparatus body, and the cartridge 30 is placed on the base plate 50 so that its position is secured.

Namely, as shown with a one-dot chain line, on the condition that the base plate 50 is placed at its lower position and the arms 51 are engaged with a lock member 52, the cartridge 30 is brought in contact with the stop pin P2 and is set at the predetermined image forming position. When the lock member 52 is operated so as to retract in the direction perpendicular to the sheet surface of FIG. 5, the arms 51 are released from the engagement with the lock member 52, the base plate 50 is moved upward together with the cartridge 30 by the biasing force of coil spring 53 and the base plate is stopped at the shifted position on which the arms 51 come in contact with stop pin P3.

On the condition that the cartridge 30 is stopped at the shifted position, the conveying section for the transfer sheet including the transfer section for the toner image is opened widely so that the maintenance works such as the jam-paper removing can be conducted. Further, when the photoreceptor drum 10 is withdrawn from the cartridge 30 in the axial direction and separated from the optical exposure systems 12, the cleaning or replacing works for the optical system can be conducted.

FIG. 4 is a developed view of the cartridge 30, the supporting member 20 on which all of the optical exposure systems 12 are supported is fastened from the back side of the cartridge 30 with screw members 21 and is fixed to the cartridge 30. The hollow portion provided on the front end plate of the photoreceptor drum 10 is fitted with the shaft 22 on the front end plate of the supporting member 20, on the other hand, the cylinder portion at the rear end of the photoreceptor drum 10 is fitted with the outer peripheries of plural guide rollers R provided on the inside of the cartridge 30, whereby the photoreceptor drum 10 is rotatably supported.

In the above construction, by the removing of the front cover from the cartridge 30, the photoreceptor drum 10 can be detached from the inside of the cartridge 30 so that the photoreceptor drum 10 can be separated from the optical exposure system 12. When the photoreceptor drum 10 is detached, the contacting member of each developing device 13 is released from the pressure contact with the periphery surface of the photoreceptor drum 10 with the aid of the pressing device and is spaced from the periphery surface of the photoreceptor drum 10, whereby the photoreceptor drum 10 can be safely attached to or detached from the cartridge 30 without being damaged.

Figure 8:
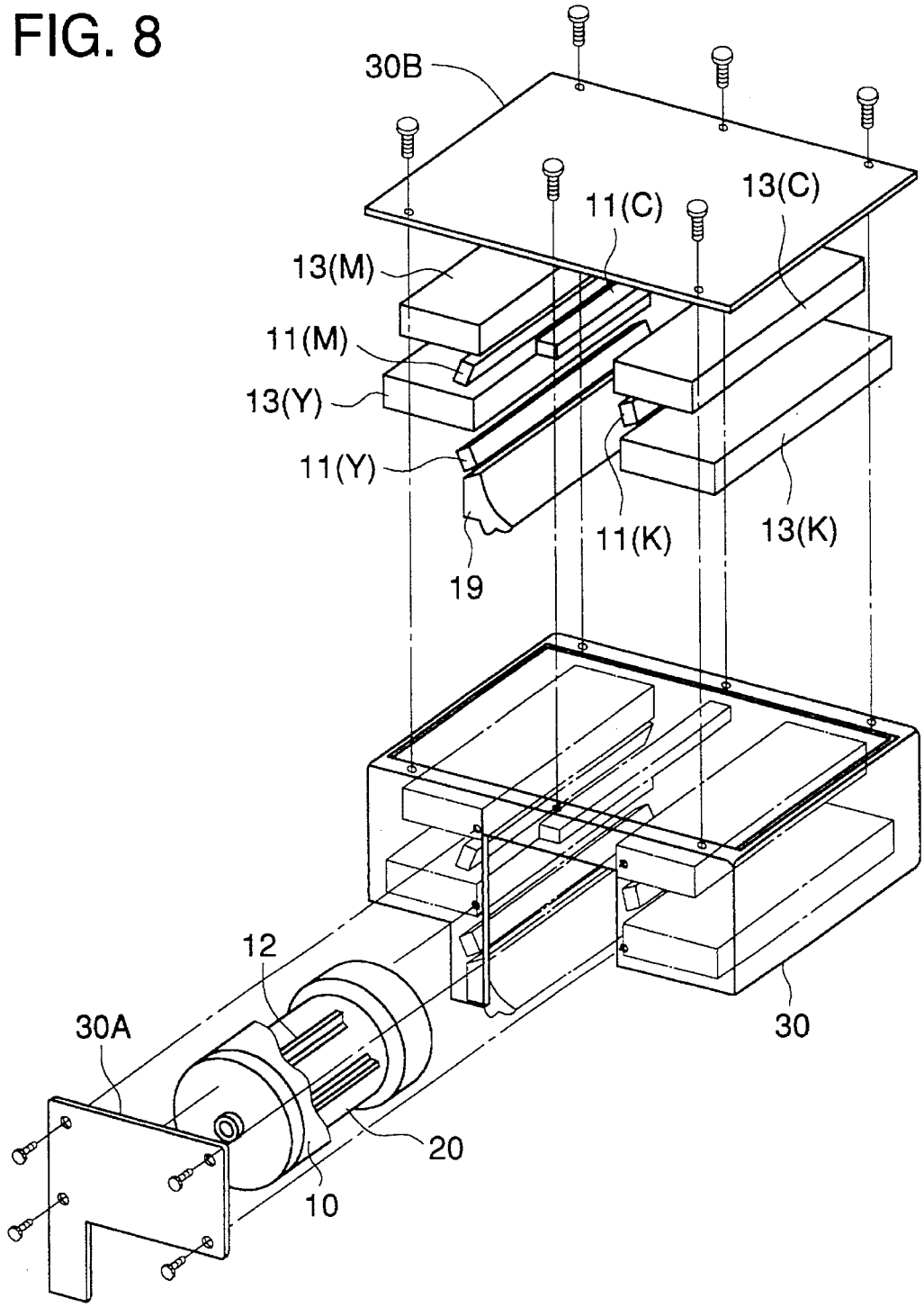
FIG. 8 is a perspective view of the cartridge (second type).

An embodiment regarding "(c) Maintenance" will be explained with reference to FIGS. 4, 5 and 8.

A base plate 50 which is moved in parallel upward or downward by the support of paired arms 51 provided as shown in FIG. 5 is provided in the apparatus body, and the cartridge 30 is placed on the base plate 50 so that its position is regulated.

As shown with a one-dot chain line, on the condition that the base plate 50 is placed at its lower position and the arms 51 are engaged with a lock member 52, the cartridge 30 is brought in contact with the stop pin P2 and is set at the predetermined image forming position. When the lock member 52 is operated so as to retract in the direction perpendicular to the sheet surface of FIG. 5, the arms 51 is released from the engagement with the lock member 52, the base plate 50 is moved upward together with the cartridge 30 by the biasing force of coil spring 53 and the base plate is stopped at the shifted position on which the arms 51 come in contact with stop pin P3.

FIG. 4 is a developed view of the cartridge 30, the supporting member 20 on which all of the optical exposure systems 12 are supported is fastened from the back side of the cartridge 30 with screw members 21 and is fixed in the cartridge 30. The hollow portion provided on the front end plate of the photoreceptor drum 10 is fit with the shaft 22 on the front end plate of the supporting member 20, on the other hand, the cylinder portion at the rear end of the photoreceptor drum 10 is fit with the outer peripheries of plural guide rollers R provided on the inside of the cartridge 30, whereby the photoreceptor drum 10 is rotatably supported.

In the above construction, by the removing of the front cover 30A from the cartridge 30, the photoreceptor drum 10 can be detached from the inside of the cartridge 30 so that the photoreceptor drum 10 can be separated from the optical exposure system 12. When the photoreceptor drum 10 is detached, the contacting member of each developing device 13 is released from pressure contact with the peripheral surface of the photoreceptor drum 10 with the aid of the pressing device and is spaced from the periphery surface of the photoreceptor drum 10, whereby the photoreceptor drum 10 can be attached to or detached from the cartridge 30 safely without being damaged. Further, the cartridge 30 is structured in such a way that when its upper cover 30B is removed at the shifted position, its upper section is opened. Accordingly, on the condition that the cartridge 30 is kept being placed on the base plate 50, the charging devices 11, the developing devices 13 and the cleaning device 19 which are accommodated in the cartridge 30 can be cleaned, dismounted or remounted through the opened upper section.

Consequently, each of the image forming devices including the photoreceptor drum 10 and the optical exposure device 12 which are accommodated in the cartridge 30 can be mounted or dismounted from time to time without dismounting the cartridge 30 from the apparatus body. As a result, the maintenance works such as the cleaning or the replacing can be conducted very efficiently.

Second Embodiment

The second embodiment will be explained with reference to FIGS. 9 through 12.

Figure 9:
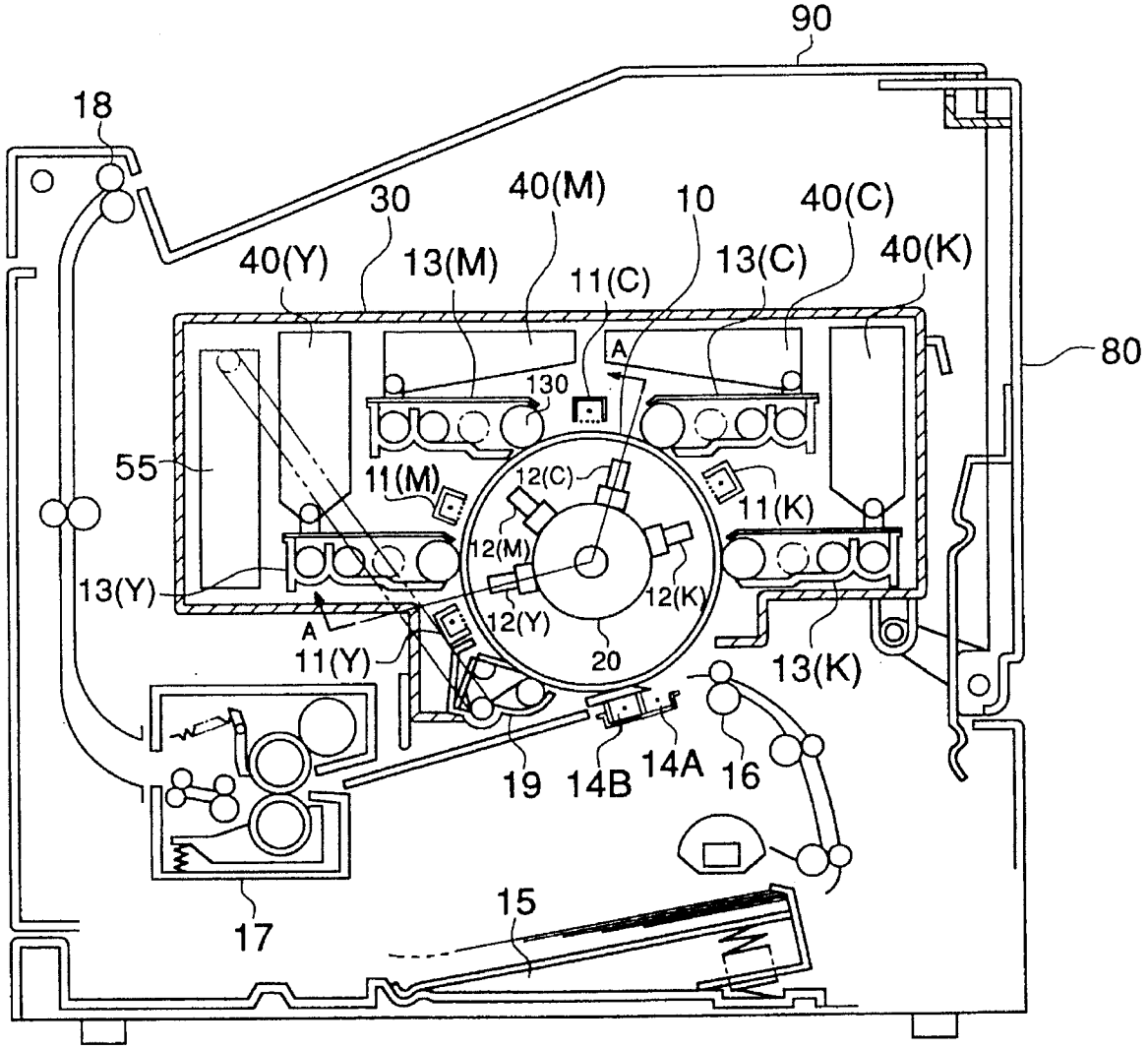
FIG. 9 is a sectional view showing construction of a color image forming apparatus of the second embodiment of the present invention.

In the present embodiment, as shown in FIG. 9, a photoreceptor drum 10 is accommodated in a process cartridge 30 together with charging devices 11, developing devices 13, cleaning device 19, toner storage containers 40 for replenishing toner to the developing devices 13 and waste toner container 55 for storing toner collected by the cleaning device 19 so that the photoreceptor drum 10 and the other devices can be pulled as a single body in a horizontal direction from the apparatus body and shifted to the outside of the apparatus body.

Figure 10:
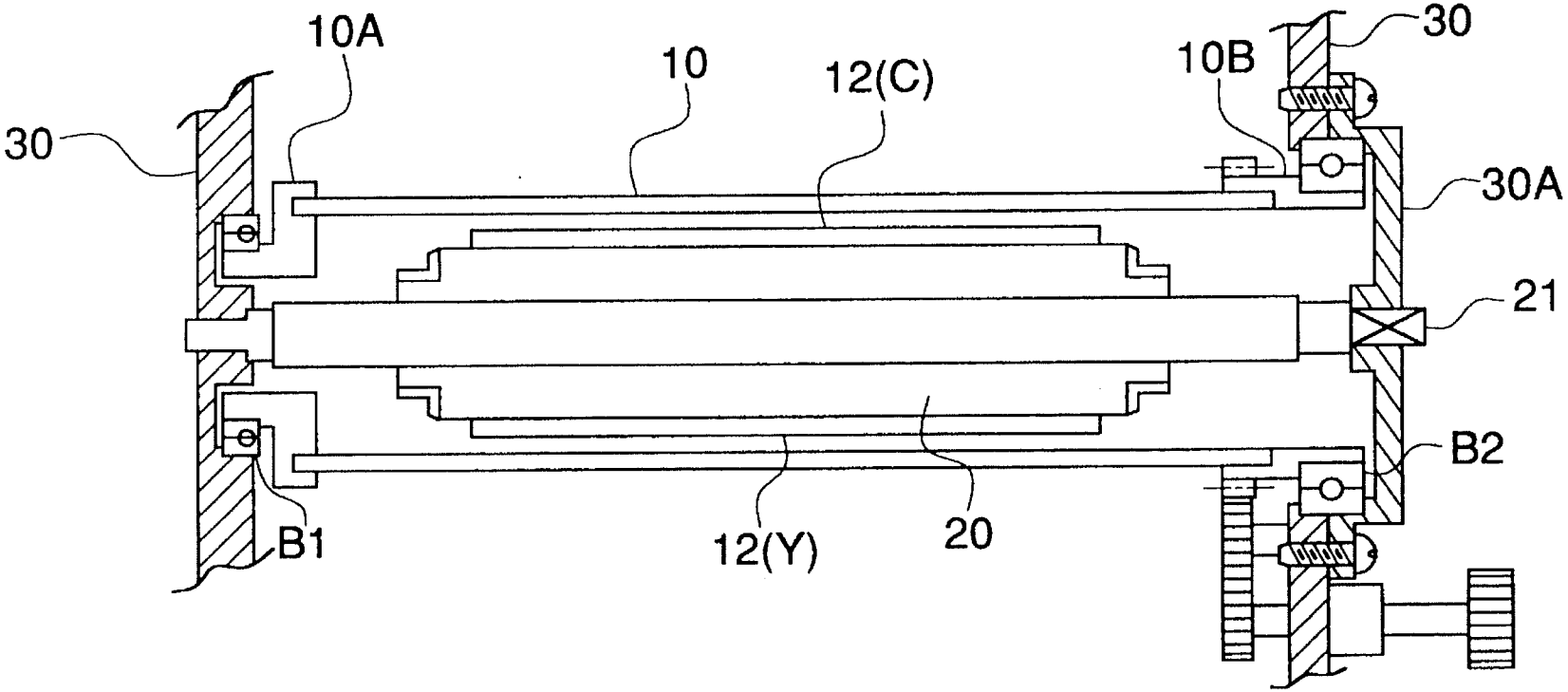
FIG. 10 is a sectional view showing construction in which a photoreceptor drum and optical exposure systems are incorporated.

In FIG. 10 showing a section A—A in FIG. 9, a flange member 10A on the front end section of the photoreceptor drum 10 is supported by a bearing B1 fixed in a wall of the process cartridge 30 and another flange 10B on a rear end section is supported by a bearing B2 held between the process cartridge 30 and a disk member 30A which can be attached to or detached from the process cartridge 30.

On the other hand, the front end of a shaft member 21 inserted into the supporting member 20 is engaged in a hole in a wall of the process cartridge 30 and the rear end is engaged in a hole in the disk member 30A so that the optical exposure systems 12 are supported on the condition that their rotation is restricted.

Accordingly, by detaching the disk member from the process cartridge 30, the photoreceptor drum 10 and the optical exposure system 12 can be dismounted easily from the rear side of the process cartridge 30.

By opening a side cover 80 forming a side member of the apparatus body, the process cartridge 30 can be shifted diagonally to an upper position and further pulled out from the upper position so that the process cartridge 30 can be shifted in a horizontal direction to the outside of the apparatus body.

Figure 11:
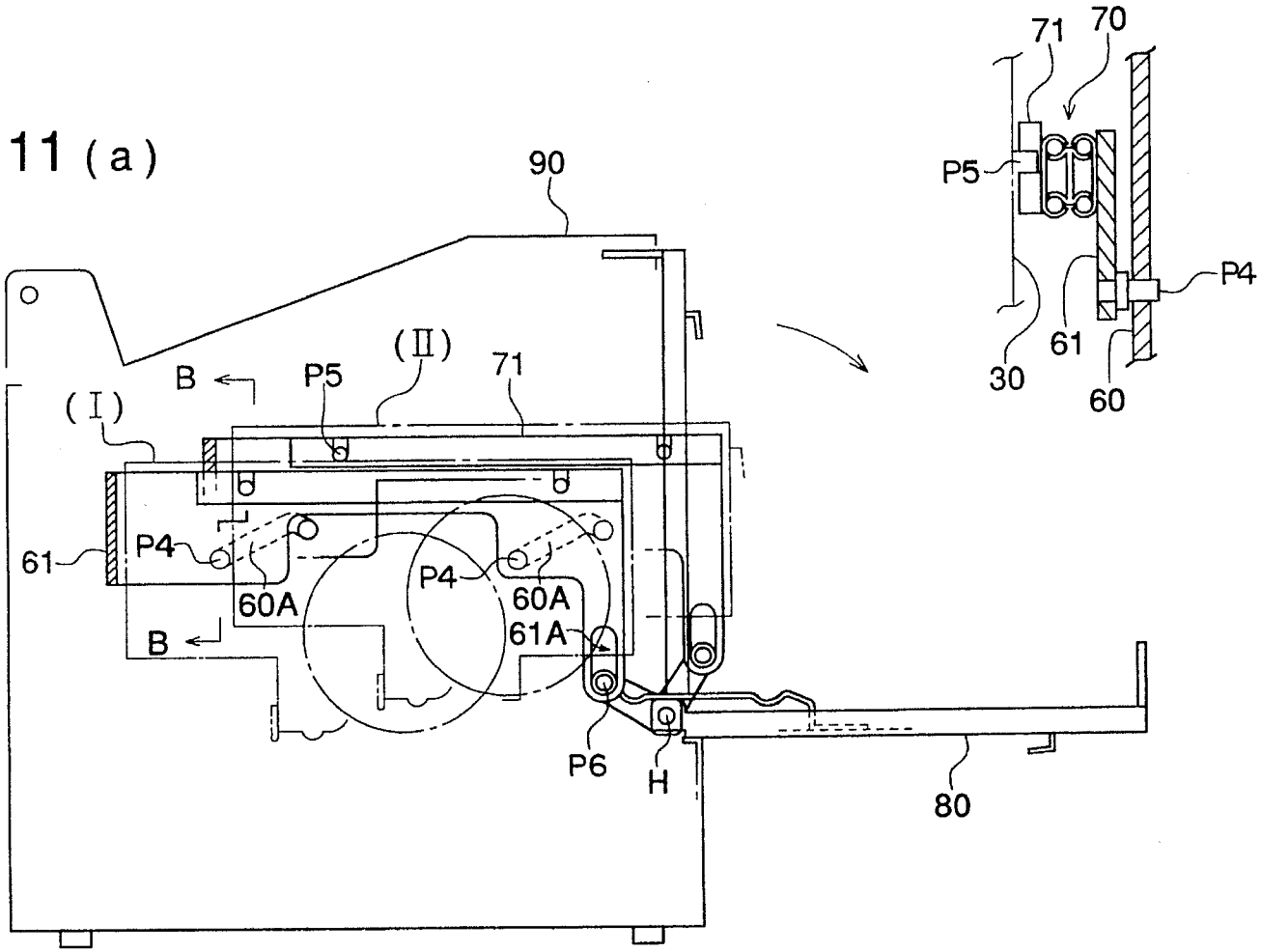
FIGS. 11(*a*) and 11(*b*) are explanatory views showing the relationship between an image forming position and a drawn-out position of a process cartridge.

FIG. 11(*a*) shows the supporting construction for the process cartridge 30, and FIG. 11(*b*) shows the section B—B of its principal parts. A pair of elongated holes 60A are provided on front and rear plates 60 in the apparatus body and pins P4 are engaged in the elongated holes 60A so that the a pair of liftable plates 61 linked with the pins P4 are supported to be slidable in a upward diagonal direction and further in a downward diagonal direction.

On the inside of the liftable plate 61 is attached a guide member 70 capable of expansion and contraction in two stages with three sets of rails so called "arcuride rails", and furthermore to each inside rail is attached a shifting plate 71.

Each of the shifting plates 71 is provided with a pair of cut-out section shaped in the form of the letter "U" on its positions opposite to each other, and pins P5 are engaged with the cut-out sections, whereby the process cartridge 30 is supported.

On the other hand, the liftable plate 61 is provided with an elongated hole 61A which is longer in its vertical direction, and pin P6 on an arm pivotal together with the side cover 80 around a rotation axis H is loosely engaged in the elongated hole 61A.

When the side cover 80 is opened by being rotated clockwise and be placed horizontally on a stop position, with the movement of the pin P6, the pin P4 is slid in the elongated hole 60A in such the way that the pin P4 moves firstly in the upward diagonal direction and then in the downward diagonal direction. Thereafter, the pin P4 is stopped. Through the above motions, the process cartridge 30 is released from the image forming position (I), disengaged from timing rollers 16, a transfer device 14A and a charge eliminating device 14B and shifted to a drawn-out position (II).

Figure 12:
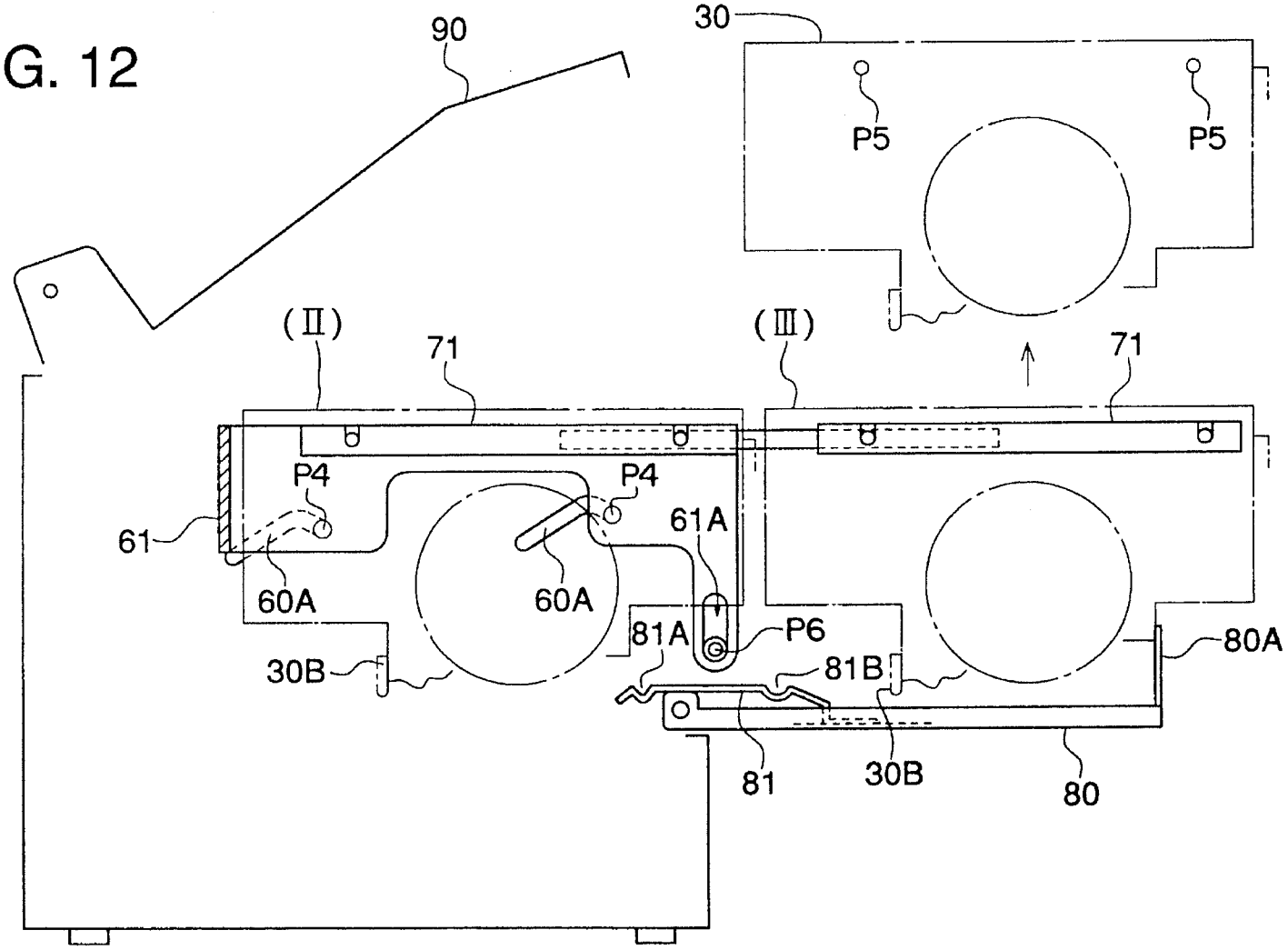
FIG. 12 is an explanatory view showing a construction to draw out the process cartridge and specified stop positions.

When the process cartridge 30 is further withdrawn from the drawn-out position, as the guide member 70 is extended, the process cartridge 30 keeps its horizontal condition as shown in FIG. 12 and is shifted to the outside of the apparatus body. In the course of the above draw-out operation, an engaging member 30B provided on the lower end of the cartridge 30 comes sequentially in engagement with concave sections 81A and 81B on an elastic member 81 provided on the inside of the side cover 80, whereby the cartridge 30 may be stopped at a specified position.

That is, on the position that the engaging member 30B comes in engagement with the concave 81A on the elastic member 81, the image transfer section in the apparatus body is opened. Accordingly, the opening of the upper cover 90 makes it possible to remove a jam-paper. On the position that the engaging member 30B comes in engagement with the concave 81B, the optical exposure systems 12 may be replaced with a spare one through the rear side of the cartridge 30. On the stop position (III) that the cartridge 30 is further drawn out so as to bring the cartridge 30 in contact with a standing section 80A on the side cover 80, the waste toner container 50 can be dismounted. Moreover, on the stop position (III), the pin P5 can be released from the engagement with the shifting plates 71 and the cartridge 30 can be separated and dismounted upward.

When the process cartridge 30 restricted so as to stop at one of the specified positions is shifted so as to be pushed into the apparatus body, the guide member 70 is contracted and the cartridge is returned to the drawn-out position. During this shift, since the pin P4 stops by its weight on the end of the elongated hole 60A of the plate 60, the liftable plate 61 is kept on the stop condition. Next, when the side cover 80 is rotated counterclockwise so as to close and becomes the vertical condition, as the pin P6 shifts, the pin P1 is slid along the elongated hole 60A in the upward diagonal direction and in the downward diagonal direction and the liftable plate 61 stops at the initial position, whereby the process cartridge 30 is returned to the image forming position (I) without contacting the transfer device 14A and so on.

Accordingly, the maintenance works such as the inspection for the process cartridge 30, the replacement of the process cartridge 30, the removing of a jam-paper, the toner supply, the waste toner collection can be easily conducted by operations from one side of the apparatus body.

Incidentally, in the second embodiment, the type of image forming apparatus in which the optical exposure system 12 is installed inside the photoreceptor drum 10 is taken as an example for the explanation purpose. However, as same as the first embodiment, the second embodiment can be applicable to the other type of image forming apparatus in which the optical exposure systems 12 are mounted on the cylindrical supporting member provided coaxially around the outer periphery of the photoreceptor drum 10 and the imagewise exposure for the photosensitive member on the photoreceptor drum 10 is conducted from the outside of the photoreceptor drum 10. In the other type of image forming apparatus, the objective of the present invention may be attained with the structure that the devices are accommodated in a cartridge and, when the side cover is opened, the cartridge is drawn out in the horizontal direction from an image forming position and is stopped at a specified position.

As described above, in the present invention, the image forming members including the photoreceptor drum are structured to form a cartridge shiftable in association with the apparatus body. Accordingly, when the cartridge is shifted, a transfer sheet conveyance section including an image transfer section is opened widely, and a cleaning operation and a replacing operation for the photoreceptor drum and the optical exposure system accommodated in the cartridge are conducted easily. As a result, it can be possible to provide a color image forming apparatus which is superior in removing a jam-sheet or in maintaining each process material for forming an image.

Furthermore, with structures of the present invention, daily maintenance works such as inspections or replacements for the photoreceptor drum and the devices used for forming an image, toner replenishment and waste toner collection can be conducted easily. As a result, with excellent maintenance works, the color image forming apparatus capable of always forming a high quality image may be provided.

What is claimed is:

1. An apparatus for forming a color image by superimposing plural different color component toner images, comprising:

an image carrying member shaped as a cylinder and rotatable around its rotation axis, the image carrying member having a working position at which the color image is formed on the image carrying member, the image carrying member having a driven gear provided outside the cylinder;

a driving gear adapted to engage with the driven gear of the image carrying member so that the image carrying member is rotated by the driving gear;

charging means for charging the image carrying member;

image exposure means for exposing the charged image carrying member so that a latent image is formed on the image carrying member;

developing means for developing the latent image into a toner image;

each of the charging means, the image exposure means and the developing means provided by plural sets corresponding in number to plural different color components and placed in such an arrangement that the plural different color component toner images are superimposed on the image carrying member during a single rotation of the image carrying member;

a common supporting member by which the plural image exposure means are supported, with the common supporting member and the plural image exposure means being incorporated inside the cylinder of the image carrying member; and all of the plural image exposure means, the common supporting member and the image carrying member constructed in a single body in which the image carrying member is rotatable around the plural image exposure means, the single body being shiftable in a direction perpendicular to the rotation axis of the image carrying member from or to the working position of the image carrying member, whereby the driven gear of the image carrying member is engaged with the driving gear at the working position.

2. The apparatus of claim 1, wherein all of the plural image exposure means, the common supporting member and the image carrying member are further shiftable together to the outside of the apparatus.

3. The apparatus of claim 1, further comprising a cartridge in which the plural developing means, the plural image exposure means, the common supporting member and the image carrying member are incorporated as a single unit.

4. An apparatus for forming a color image by superimposing plural different color component toner images, comprising:

an image carrying member shaped as a cylinder and rotatable around its rotation axis, the image carrying member having a working position at which the color image is formed on the image carrying member;

charging means for charging the image carrying member;

image exposure means for exposing the charged image carrying member so that a latent image is formed on the image carrying member;

developing means for developing the latent image into a toner image;

each of the charging means, the image exposure means and the developing means provided by plural sets corresponding in number to plural different color components and placed in such an arrangement that the plural different color component toner images are superimposed on the image carrying member during a single rotation of the image carrying member;

a common supporting member by which the plural image exposure means are supported, the common supporting member being a ring-shaped member which is coaxially mounted around the image carrying member; and all of the plural image exposure means, the common supporting member and the image carrying member constructed in a single body and shiftable together in a direction perpendicular to the rotation axis of the image carrying member from or to the working position of the image carrying member.

5. An apparatus for forming a color image by superimposing plural different color component toner images, comprising:

an image carrying member rotatable around its rotation axis, the image carrying member having a working position at which the color image is formed on the image carrying member;

charging means for charging the image carrying member;

image exposure means for exposing the charged image carrying member so that a latent image is formed on the image carrying member;

developing means for developing the latent image into a toner image;

each of the charging means, the image exposure means and the developing means provided by plural sets corresponding in number to plural different color components and placed in such an arrangement that the plural different color component toner images are superimposed en the image carrying member during a single rotation of the image carrying member;

a common supporting member by which the plural image exposure means are supported; and a cartridge in which the plural developing means, the plural image exposure means, the common supporting member and the image carrying member are incorporated as a single unit, the cartridge being shiftable in a direction perpendicular to the rotation axis of the image carrying member between the working position of the image carrying member and a predetermined shifted position.

6. The apparatus of claim 5, wherein the image carrying member is shaped as a cylinder.

7. The apparatus of claim 3, wherein the common supporting member is a bar-shaped member which is inserted inside the image carrying member together with the plural image exposure means.

8. The apparatus of claim 6, wherein the common supporting member includes a ring-shaped member which is coaxially mounted around the image carrying member.

9. The apparatus of claim 5, further comprising an apparatus body including a top cover, wherein the shifting direction is a vertical direction, and the top cover is opened before the cartridge is shifted in the vertical direction.

10. The apparatus of claim 9, further comprising plural toner storage containers differing in color from which each different color toner is supplied to corresponding one of the plural developing means, wherein the plural toner storage containers are attached to the top cover.

11. The apparatus of claim 10, wherein the plural toner storage containers are separated upward from the plural developing means before the cartridge is shifted in the vertical direction.

12. The apparatus of claim 5, further comprising an apparatus body including a side cover, wherein the shifting direction is a horizontal direction, and the side cover is opened before the cartridge is shifted in the horizontal direction.

13. The apparatus of claim 12, wherein the cartridge is regulated by the side cover so as to stop at the predetermined shifted position.

14. The apparatus of claim 13, wherein the cartridge is dismounted upward from the predetermined shifted position to the outside of the apparatus.

15. The apparatus of claim 5, wherein when the cartridge is located at the predetermined shifted position, the transfer means is separated from the image carrying means so that an image transfer section including a sheet conveying passage becomes accessible from the outside of the apparatus, whereby a jam-sheet is removed from the image transfer section and the sheet conveying passage.

16. The apparatus of claim 5, wherein when the cartridge is located at the predetermined shifted position, the plural image exposure means are mounted to or dismounted from the cartridge.

17. The apparatus of claim 16, wherein the plural image exposure means are mounted or dismounted in the axial direction of the image carrying member.

18. The apparatus of claim 5, wherein when the cartridge is located at the predetermined shifted position, the plural developing means, the plural image exposure means, and the image carrying member are constructed respectively in such an arrangement that maintenance works are conducted for each of them independently of others.

19. The apparatus of claim 5, wherein the plural developing means are arranged symmetrically at the right and left sides of the image carrying member on both of a horizontal plane including the rotation axis of the image carrying member and a parallel plane parallely positioned upward or downward from the horizontal plane.

20. The apparatus of claim 19, wherein each of the developing means is provided with a driven gear and a driving gear for each of the driven gears is fixed in the apparatus, and the shifting direction of the cartridge is a vertical direction, and wherein when the cartridge is shifted upward from or downward to the working position of the image carrying member, the driven gears are disengaged from or engaged with the driving gears.

21. The apparatus of claim 20, wherein the image carrying member is provided with a driven gear and a driving gear for the driven gear of the image carrying member is fixed in the apparatus, and wherein when the cartridge is shifted upward from or downward to the working position of the image carrying member, the driven gear of the image carrying member is disengaged from or engaged with the driving gear associated therewith.

* * * * *